US007784120B2

(12) United States Patent
Spicer

(10) Patent No.: US 7,784,120 B2
(45) Date of Patent: Aug. 31, 2010

(54) SUPPORT STRUCTURE FOR A SPA

(76) Inventor: Wade Spicer, R.R. 1 Route 11, Box 108, Northumberland, PA (US) 17857-0108

( * ) Notice: Subject to any disclaimer, the term of this patent is extended or adjusted under 35 U.S.C. 154(b) by 201 days.

(21) Appl. No.: 12/284,899

(22) Filed: Sep. 25, 2008

(65) Prior Publication Data

US 2009/0064405 A1 Mar. 12, 2009

Related U.S. Application Data

(63) Continuation of application No. 10/995,919, filed on Nov. 22, 2004, now abandoned.

(51) Int. Cl.
*A47K 3/00* (2006.01)
*A47K 3/16* (2006.01)

(52) U.S. Cl. ..... 4/592; 4/541.1; 4/593

(58) Field of Classification Search ..... 4/541.1, 4/584, 592, 593, 595
See application file for complete search history.

(56) References Cited

U.S. PATENT DOCUMENTS

| | | | |
|---|---|---|---|
| 4,289,717 | A | 9/1981 | Bortz |
| 4,546,505 | A | 10/1985 | Wakenshaw |
| 4,843,659 | A | 7/1989 | Popovich et al. |
| 5,345,622 | A | 9/1994 | Plone |
| 5,494,718 | A | 2/1996 | Adams et al. |
| 5,727,264 | A | 3/1998 | Craig et al. |
| 5,864,898 | A | 2/1999 | Knapp et al. |
| 6,243,889 | B1 | 6/2001 | Ducharme et al. |
| 6,349,427 | B1 | 2/2002 | Bergstrom |
| 6,421,846 | B1 | 7/2002 | Shaanan et al. |
| 6,618,868 | B2 | 9/2003 | Minnick |
| 6,647,562 | B1 | 11/2003 | Arout et al. |
| 6,839,919 | B2 | 1/2005 | Pugliese et al. |
| 6,904,625 | B1 | 6/2005 | Podue et al. |
| 7,020,910 | B1 | 4/2006 | Horwood |

*Primary Examiner*—Tuan N Nguyen
(74) *Attorney, Agent, or Firm*—Thomas R. Shaffer

(57) ABSTRACT

A support structure for a spa includes a plastic base member which has an upper wall portion and a lower wall portion which are spaced apart. The base member defines a base pocket of insulating space which extends throughout a substantial portion of the base member. A pair of plastic side members and a pair of plastic end members are attached to the base member. The side members and the end members each have an inside wall portion and an outside wall portion which are also spaced apart which define a wall pocket of insulating space which extends throughout a portion of each of these members. The base member, side members and end members form a support structure adapted to receive and support a spa shell. Any type of insulating material may be placed into the insulating pockets of space. Accessory devices in the form of towel warmers and fold away steps are provided in openings in the support structure.

19 Claims, 5 Drawing Sheets

SUPPORT STRUCTURE FOR A SPA

This application is a continuation of U.S. application Ser. No. 10/995,919 which was filed on Nov. 24, 2004 now abandoned.

BACKGROUND OF THE INVENTION

1. Field of the Invention

The present invention relates to a support structure for a spa. More specifically, the present invention relates to a support structure for a spa which includes a plastic base member and plastic side and end members to support a spa shell without the need for a wooden frame or any other type of sub-frame.

2. Prior Art

The construction of spas is well known in the art. Typically, a spa is created by forming a wooden sub-frame made out of wooden two by fours (or possibly a metal support frame or truss members) with an exterior wooden wanes coating or the like attached as an outer surface. Alternatively, a sub-frame made with two by fours or the like can be created which is coated on the outside with a form of plastic single wall panels. The wooden support frame typically then receives a formed acrylic or other type of plastic spa shell as is well known in the art.

SUMMARY OF THE INVENTION

The present invention eliminates the need for a wooden or any other type of sub-frame and provides a number of benefits and advantages over the prior art. For example, in the present invention, by utilizing interconnecting plastic base members and side and end members, the cost of building the wooden frame is completely avoided. Further, because each of the plastic components of the present invention has a double wall design, a pocket of space is created within such components which can be filled with an insulating material such as air or a foam insulation. The double wall construction significantly adds strength to the structure eliminating the need for the wooden (or other) frame or sub-frame. Such added strength makes is easier to lift the spa with a fork lift or the like without damaging the spa and makes it easier to safely transport the spa without causing damage. Further, by providing pockets of space (which may or may not be fully enclosed) between the double wall construction, each of the outer shell components are extremely well insulated both with respect to noise as well as to temperature. By providing a double wall molded plastic base member with an insulating pocket of space, the spa is insulated from ground temperatures, is more resistant to the water and mud, and is more resistant to termites and rodents than existing spas.

In its simplest form, the support structure for a spa comprises a plastic base member, said base member having an upper wall portion, a lower wall portion and a spacing means preferably in the form of a perimeter wall portion, said wall portions may or may not fully enclose a base pocket of space which extends throughout a substantial portion of said base member between the upper wall portion and the lower wall portion; and a pair of plastic side members and a pair of plastic end members attached to said base member, said side members and said end members each having an inside wall portion, an outside wall portion and spacing means preferably in the form of a perimeter wall portion, said wall portions may or may not fully enclose a wall pocket of space which extends throughout a portion of each of said side members and each of said end members between said inner and outer wall portions, said base member, side members and end members forming a support structure adapted to receive and solely support an spa shell which is typically formed of acrylic or other type of plastic or composite material. Preferably, said pockets of space contain either air or an insulating foam material.

Preferably, said upper wall portion and said lower wall portion of said base member each have corrugations therein to provide added strength. Preferably, said corrugations are in the form of a waffle like corrugation pattern.

Preferably, said upper wall portion of said base member is formed to have upwardly extending L-shaped corner posts to aid in positioning and supporting said end members and said side members onto said base member. Preferably, said upper wall portion of said base member is formed to have upwardly extending inner posts and upwardly extending outer posts to aid in positioning and supporting inside wall and outside wall members of said end members and of said side members onto said base member.

Preferably, said end members and said side members are bolted together and are bolted to said base member.

Preferably, said outside walls of said side and end members constitute the outermost side and end surfaces of a fully assembled spa. Preferably, said outside walls of said side and end members, because they are made of molded plastic, can be formed to include any conceivable type or kind of decorative elements.

Preferably, said side members and said end members have interlocking tabs to aid in proper positioning of said members during assembly and to aid in securing said members together.

Preferably, said side members and said end members have openings therein to receive door members to provide access to an interior of the support structure or to receive accessing devices such as a towel warmer or set of steps which are pivotally mounted in said openings.

Preferably, a spa shell is received by and solely supported by said support structure to create a fully functional spa.

DETAILED DESCRIPTION OF THE PREFERRED EMBODIMENTS

Figure 1:
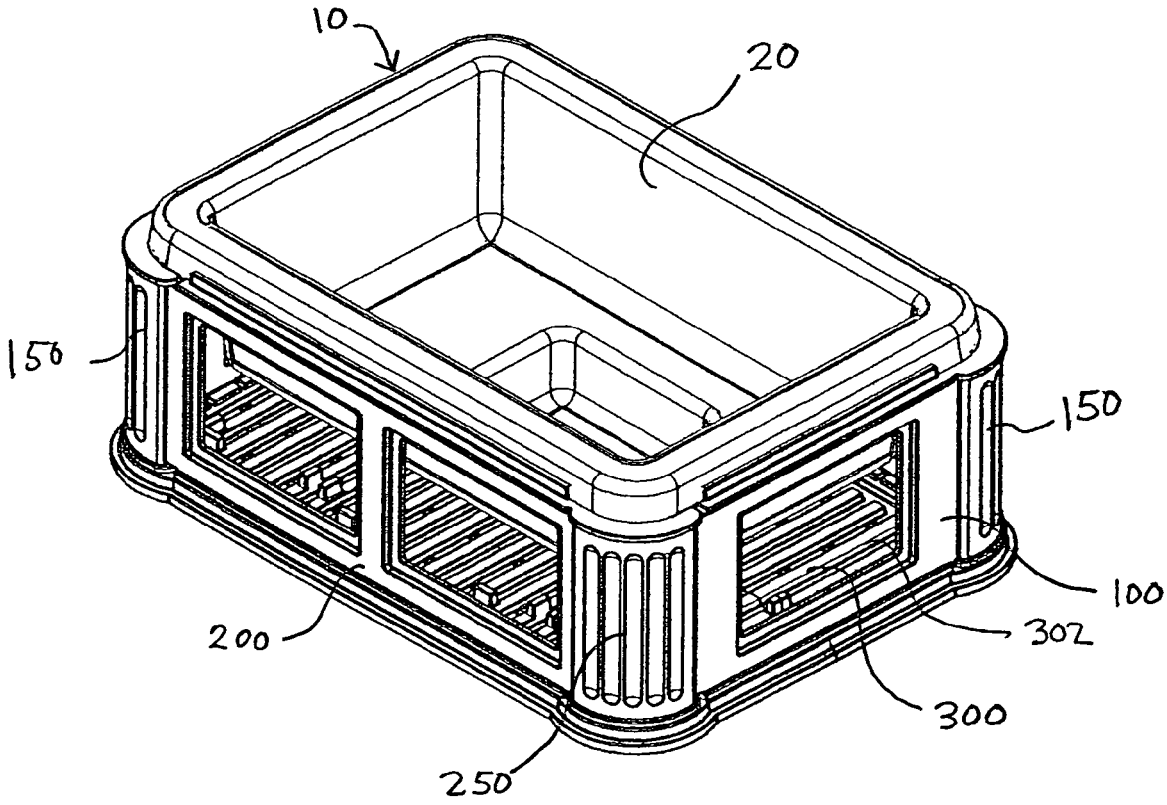
FIG. 1 is a perspective view of a rectangular spa assembly including an installed spa shell.

Referring to the figures, the present invention includes a support structure 10 for a spa which includes a base member 300, a pair of end portions 100 and a pair of side members 200. A spa shell 20 which is preferably formed of acrylic but may be formed of any suitable plastic material or other impermeable material is fully supported by the end members 100, side members 200 and base member 300. The spa shell 20 is designed to hold water for use of the spa.

Figure 4:
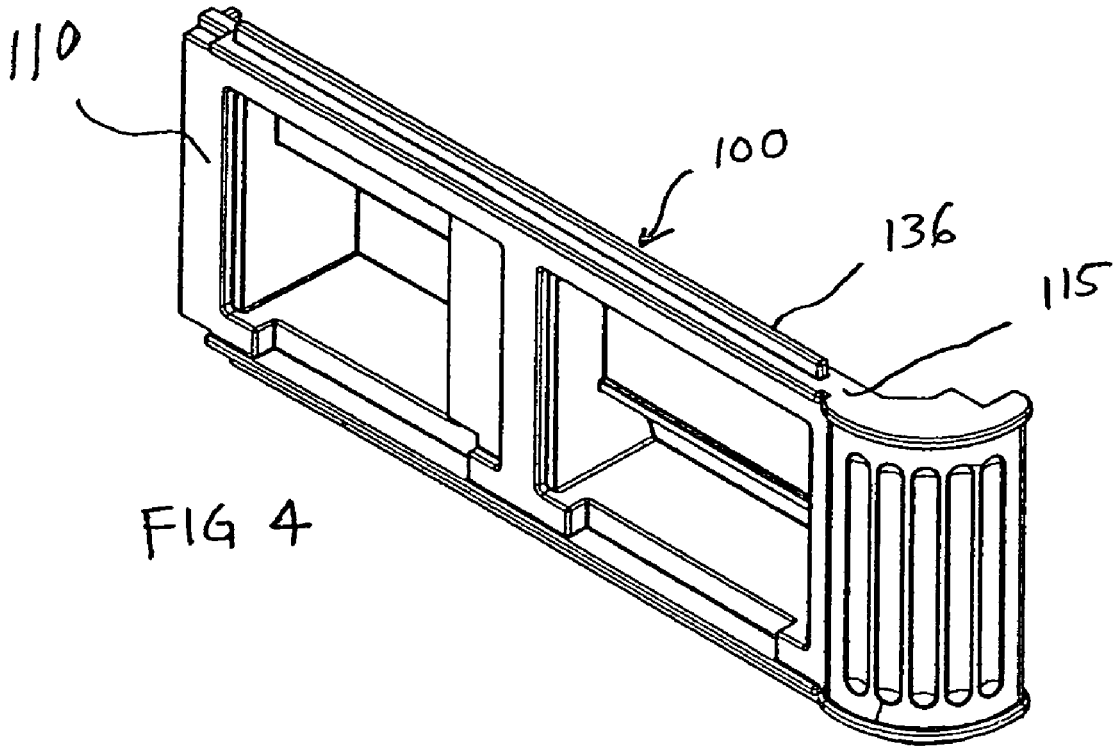
FIG. 4 is a perspective view of an outside wall portion of a side member.
Figure 5:
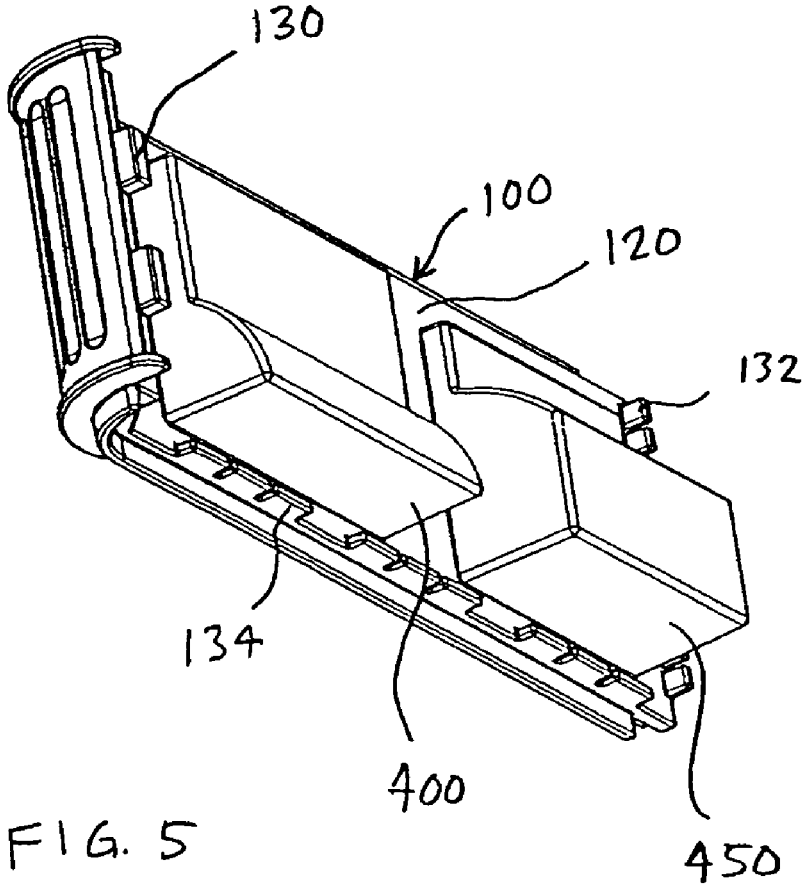
FIG. 5 is a perspective view of an inside wall portion of a side member.
Figure 6:
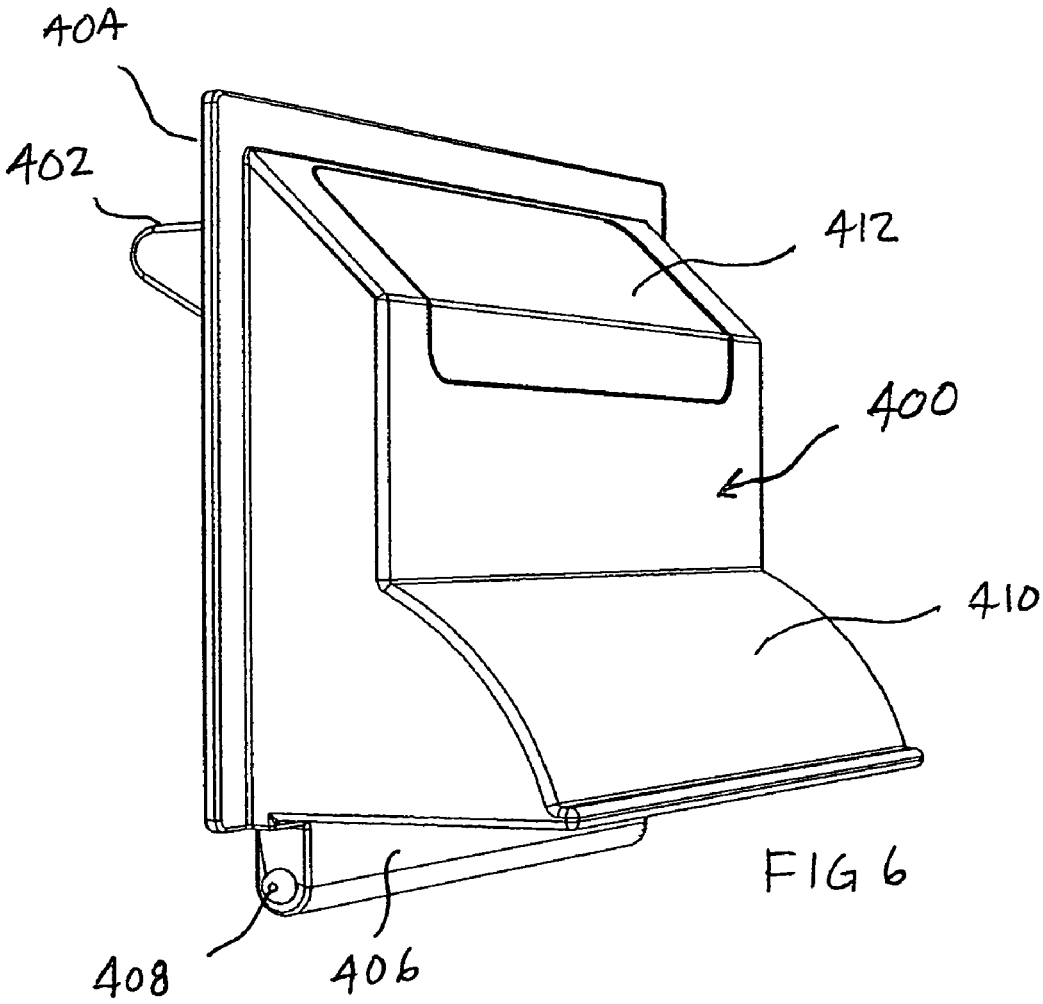
FIG. 6 is a perspective view of a towel warming accessory.
Figure 7:
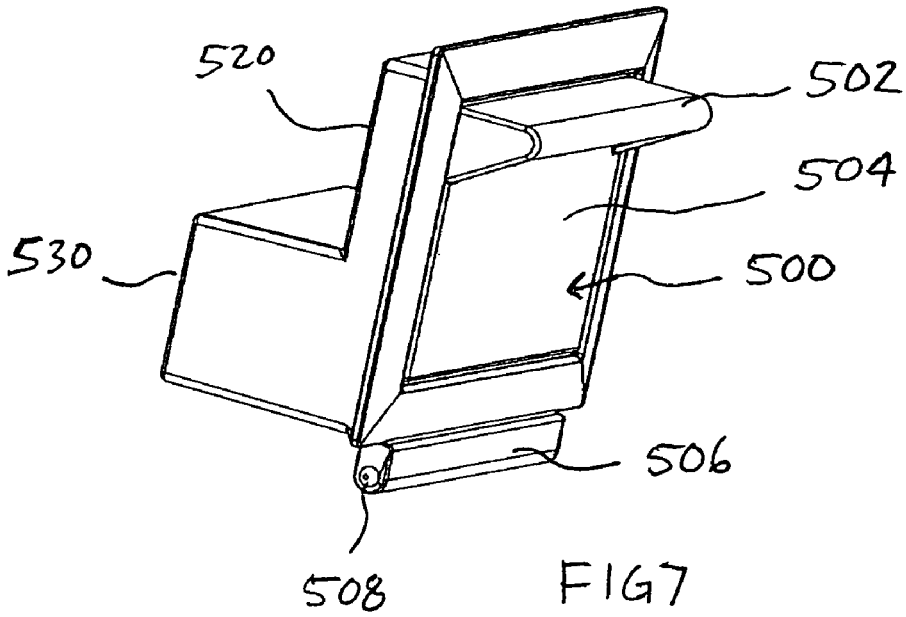
FIG. 7 is a perspective view of an accessory device in the form of a pair of steps.

Referring to FIGS. 4 and 5, an end member 100 is shown. End member 100 has an outside wall 110, an inside wall 120 and a perimeter wall portion 115 which fully encloses an air pocket 117. End member 100 has an outer surface formed in the shape of a decorative column 150 although it will be obvious to those of skill in the art that any type of kind of decorative element may be molded or otherwise formed into the outer surface of the end members 100 and side members 200. A series of tabs 130, 132, 134 and 136 are utilized to aid in interconnecting end members 100 with side members 200, base member 300 and spa shell 20. An opening 160 is provided to allow for the placement of a removable insulated door to provide a means of access to the inside of the support structure.

Alternatively, opening 160 may be utilized to receive an accessory device. It is envisioned that an accessory device may take the form of a towel warming container in the form of container 400 or 450 or may take the form of a set of steps as shown at 500.

The towel warming accessory 400 includes a handle 402, a face plate 404 having an outer flat surface, a mounting flange 406, a pivotal connection 408, a container portion 410 which receives towels and a door member 412 to provide access to the interior of the container 410.

Figure 2:
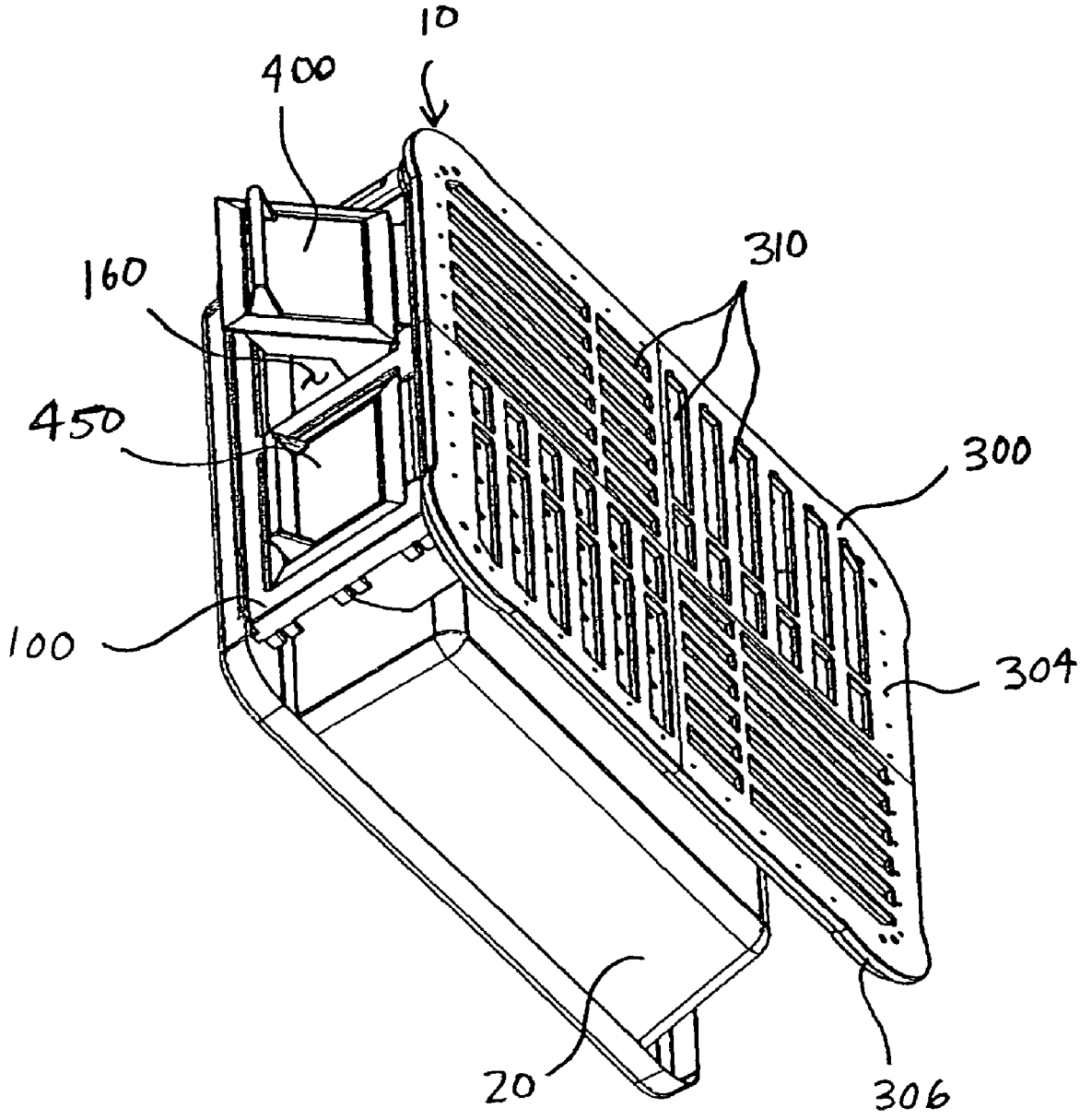
FIG. 2 is a perspective view of the rectangular spa assembly of FIG. 1 showing the bottom thereof.

The accessory device in the form of a set of steps 500 includes a handle 502, a face plate 504 having an outer flat surface, a mounting flange 506, a pivotal mounting device 508 and a pair of steps 520 and 530. It will be obvious that once the handle 502 is pulled downwardly, the steps 520 and 530 will be placed in a horizontal position allowing a user to step on said steps 520 and 530 to gain access to the interior of the spa shell 20. It is noted that the accessory devices are preferably pivotally attached and open in the manner illustrated by towel warmer device 400 as shown in FIG. 2. When closed, the face plate 504 covers the opening 160 with the steps 520 and 530 located inward of a side wall 200 (or end wall 100) in which they are mounted. In a open position, the steps 520 and 530 extend outward of a side wall 200 (or end wall 100) in which they are mounted. Thus, while in a closed position, the accessory device is located completely inside the spa walls and does not impede or interfere with lawn maintenance or other activities around the perimeter of the spa.

It is to be understood that the side members 200 may be identical to the end members 100 in which case the spa would be a square. Alternatively, the side members 200 may be longer than end members 100 in which case the spa will be rectangular in shape. Obviously, variations can be made to accommodate any shaped spa desired by the provision of additional pieces with different angles of interconnection. In the figures, the end member and side member components have the same corresponding last two digits, but side member components are prefaced by the number 200 rather than the number 100 which is utilized for an end member component. For example, tabs 130 and 134 on end member 100 are identified to tabs 230 and 234 on side member 200.

Figure 3:
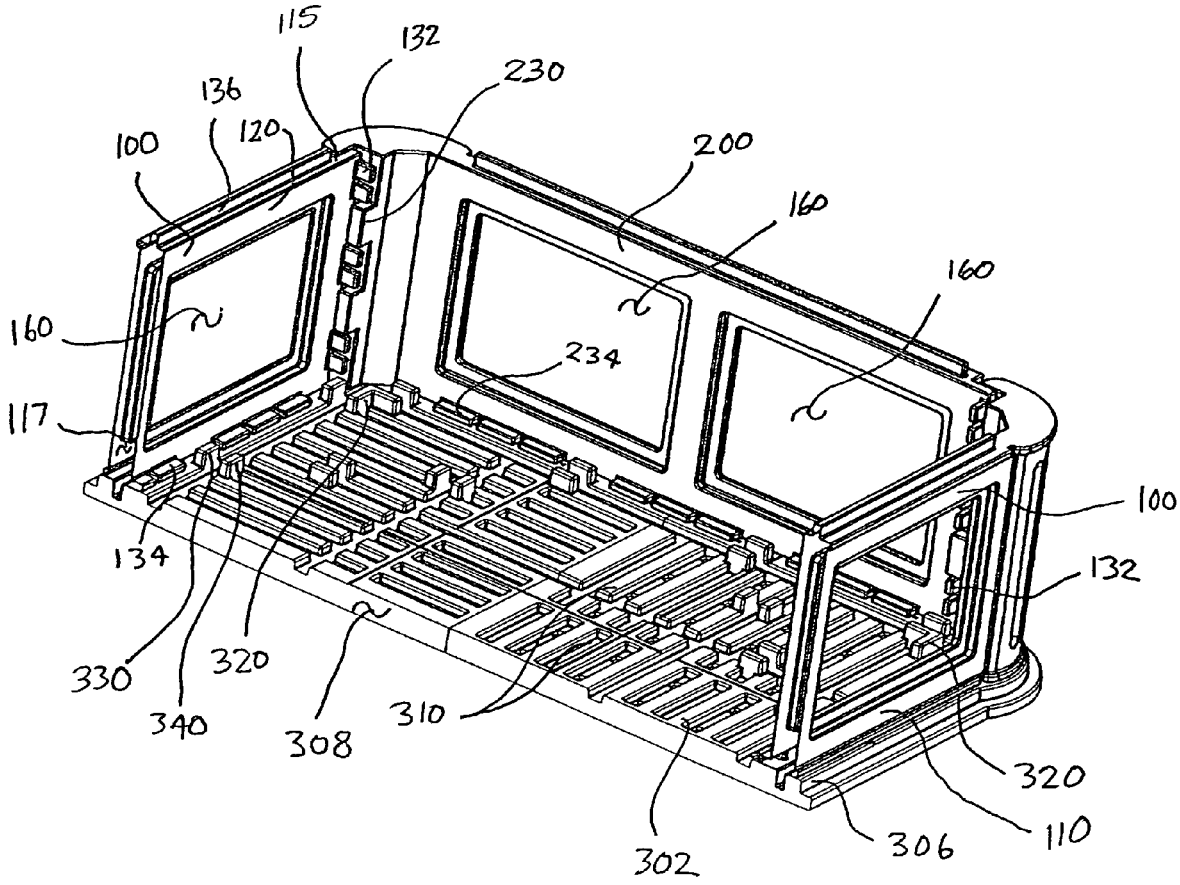
FIG. 3 is a perspective view of an interconnected end members and a side member shown partly in cross section.

A base member 300 as best shown in FIGS. 2 and 3 has an upper wall portion 302, a lower wall portion 304, each of which are provided with a waffled pattern 310 of corrugations to add strength to such wall portions. A perimeter wall portion 306 interconnects the upper wall portion 302 and the lower wall portion 304 enclosing a pocket of insulating space 308 between said walls. It will be obvious to those of ordinary skill in the art that the pocket of insulating space 308 may be fully enclosed (as shown) or may be left partially open to allow air to flow into and out of said pocket. Further, it will be obvious that said pocket of insulating space may be filled with air or alternatively with an insulating foam material or any other insulating material which provides insulation from sound and temperature. The upper wall portion 302 of the base member 300 is formed to have upwardly extending L-shaped corner posts 320 which in combination with upwardly extending inner posts 340 and outer posts 330 aid in positioning and supporting the end members 100 and side members 200 onto the base member 300. As shown, end members 100, side members 200 and base member 300 are all formed of plastic and each include a fully enclosed air pocket which provides insulation from sound and temperature. While an air pocket is presently preferred, some manufactures or users may prefer the pockets of insulating space to be filled with an insulating foam material. Such a foam material may provide superior insulating properties and may add to the overall strength of the structure, but will add some additional weight to the spa.

While we have shown and described the presently preferred embodiment of our invention, the invention is not limited thereto and may be otherwise variously practiced within the scope of the following claims:

I claim:

1. A support structure for a spa which includes a plastic base member, plastic side members and plastic end members to support a spa shell without the need for a wooden frame or any other type of sub-frame, said support structure comprising: an interconnected plastic base member and side outer shell panel members and end outer shell panel members, said side and end panel members constituting the outermost side and end surfaces of a fully assembled spa, said plastic base and each of said side and end panel members having a double wall design with a pocket of space created within such components which can be filled with an insulating material, said double wall construction significantly adding strength to the structure and eliminating the need for the wooden or other frame or sub-frame, said base member further comprising an upper wall portion, a lower wall portion and a spacing means to keep said upper wall portion and said lower wall portion in a spaced apart relationship, said wall portions defining a base pocket of insulating space which extends throughout a substantial portion of said base member thus creating a double wall molded plastic base member having an insulating pocket of space whereby making the spa insulated from ground temperatures; and said outer shell panel members further comprising an inside wall portion, an outside wall portion and a spacing means to keep said inside wall portions and said outside wall portions in a spaced apart relationship, said wall portions defining a wall pocket of insulating space which extends throughout a portion of each of said side members and each of said end members, said base member, side members and end members forming a support structure adapted to receive and solely support a spa shell.

2. A support structure according to claim 1 wherein said spacing means is a perimeter wall portion.

3. A support structure according to claim 1 wherein said base pocket of insulating space and said wall pocket of insulating space are each fully enclosed.

4. A support structure according to claim 1 wherein said wall pocket of insulating space and said base pocket of insulating space are filled with air.

5. A support structure according to claim 1 wherein said wall pocket of insulating space and said base pocket of insulating space are filled with an insulating foam material.

6. A support structure for a spa according to claim 1 wherein said upper wall portion and said lower wall portion of said base member each have corrugations therein to provide added strength.

7. A support structure for a spa according to claim 6 wherein said corrugations are in the form of a waffle like corrugation pattern.

8. A support structure for a spa according to claim 1 wherein said upper wall portion of said base member is formed to have upwardly extending L-shaped corner posts to aid in positioning and supporting said end members and said side members onto said base member.

9. A support structure for a spa according to claim 1 wherein said upper wall portion of said base member is formed to have upwardly extending inner posts and upwardly extending outer posts to aid in positioning and supporting inside wall and outside wall members of said end members and of said side members onto said base member.

10. A support structure for a spa according to claim 1 wherein said end members and said side members are bolted together and are bolted to said base member.

11. A support structure for a spa according to claim 1 wherein said outside walls of said side and end members include decorative elements.

12. A support structure for a spa according to claim 1 wherein said outside walls of said side and end members include a decorative element in the form of a corner pillar.

13. A support structure for a spa according to claim 1 wherein said side members and said end members have interlocking tabs to aid in proper positioning of said members during assembly and to aid in securing said members together.

14. A support structure for a spa according to claim 1 wherein said side members and said end members have openings therein.

15. A support structure according to claim 14 wherein said at least one opening is covered by an insulating door member.

16. A support structure according to claim 14 wherein said at least one opening is received by an accessory device.

17. A support structure according to claim 16 wherein said accessory device is a towel warming chamber including a face plate having an outer flat surface and a container portion which is pivotally mounted in an opening in an outer shell panel.

18. A support structure according to claim 16 wherein said accessory device is a set of steps.

19. A support structure according to claim 16 wherein said accessory device is pivotally mounted in said opening.

* * * * *